US007439828B2

(12) United States Patent
Wada

(10) Patent No.: US 7,439,828 B2
(45) Date of Patent: Oct. 21, 2008

(54) TUNABLE FILTER, DUPLEXER AND COMMUNICATION APPARATUS

(75) Inventor: Takaya Wada, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 11/553,672

(22) Filed: Oct. 27, 2006

(65) Prior Publication Data

US 2007/0052495 A1 Mar. 8, 2007

Related U.S. Application Data

(63) Continuation of application No. PCT/JP2005/020810, filed on Nov. 14, 2005.

(30) Foreign Application Priority Data

Jan. 11, 2005 (JP) ..... 2005-004146

(51) Int. Cl.
*H01P 1/205* (2006.01)

(52) U.S. Cl. ..... 333/202; 333/207

(58) Field of Classification Search ..... 333/202, 333/203, 206, 207, 223, 224, 226, 235, 134
See application file for complete search history.

(56) References Cited

U.S. PATENT DOCUMENTS 4,620,168 A * 10/1986 Delestre et al. ..... 333/202
5,191,304 A * 3/1993 Jachowski ..... 333/202
5,233,319 A * 8/1993 Mizan et al. ..... 333/219.1
6,861,928 B2 * 3/2005 Okazaki et al. ..... 333/202
7,236,069 B2 * 6/2007 Puoskari ..... 333/207

FOREIGN PATENT DOCUMENTS

| | | |
|---|---|---|
| JP | 6-061706 | 3/1994 |
| JP | 2001-102809 | 4/2001 |
| JP | 2002-141705 | 5/2002 |
| WO | WO 2004084340 A1 * | 9/2004 |

OTHER PUBLICATIONS

Written Opinion, Japanese International Search Report issued Feb. 28, 2006.

* cited by examiner

*Primary Examiner*—Seungsook Ham
(74) *Attorney, Agent, or Firm*—Ostrolenk, Faber, Gerb & Soffen, LLP

(57) ABSTRACT

Dielectrics fixed on holders respectively provided at semi-coaxial cavity resonator stages are movably inserted through an outer conductor. The holders projecting out of the outer conductor are coupled to a coupling member, and the coupling member is directed to slide or turn, so that distances between the dielectrics and the inner conductors of the resonators are varied, and accordingly frequencies of the resonators are varied at the same time. Accordingly, there is provided a tunable filter that avoids an increase in insertion loss, is high-power resistant, does not cause intermodulation, and allows a center frequency of the filter to be varied steplessly and quickly.

10 Claims, 5 Drawing Sheets

(d)

TUNABLE FILTER, DUPLEXER AND COMMUNICATION APPARATUS

CROSS-REFERENCE TO RELATED APPLICATIONS

This is a continuation of PCT/JP2005/020810 filed Nov. 14, 2005, incorporated by reference.

BACKGROUND OF THE INVENTION

1. Technical Field

The present invention relates to a tunable filter, a duplexer, and a communication apparatus, using a semi-coaxial cavity resonator.

2. Background Art

A filter allowing a center frequency thereof to be varied to a desired value according to an external control signal, is called a tunable filter. A typical example of the tunable filter may be a tuning frequency variable band pass filter as disclosed in Japanese Unexamined Patent Application Publication No. 9-284097. The filter has a plurality of short-circuit bars. Ends of the short-circuit bars are respectively fixed at a predetermined height on a lateral surface of an inner conductor bar of a semi-coaxial cavity resonator to be equally spaced, extended radially in the horizontal direction, and then bent substantially perpendicularly downward. Other ends of the short-circuit bars reach a bottom surface of an outer conductor in a circle concentric to a fixed position of the inner conductor, and are respectively connected to PIN diodes fixed on the bottom surface of the outer conductor. The PIN diodes allow the short-circuit bars to be electrically connected to/disconnected from the bottom surface of the outer conductor by applying an external control voltage, so as to control frequencies of respective resonators according to variation in inductance components due to the shorting of the short-circuit bars relative to the outer conductor, and thus, to allow a tuning frequency of the filter to be varied.

In the above-described configuration, since a plurality of ground lines continuously arranged with the PIN diodes are provided in the semi-coaxial cavity resonator, at a portion to which extremely high current is applied, the Q of the resonator may decrease, and an insertion loss may increase in a band pass filter or a band elimination filter, in which the resonators are continuously arranged.

In addition, in this configuration, since frequencies are varied according to the on/off state of the PIN diodes, a center frequency of the band pass filteror band elimination filter is varied only discretely, and may not be varied steplessly.

Also, when a filter needs to pass electricity as high as several watts to several tens of watts, a high voltage might be applied to the PIN diodes. Accordingly, the PIN diodes may be burned out, and the filter may be no longer usable.

Similarly, when the filter needs to pass electricity as high as several watts to several tens of watts, the PIN diodes, and the combination of the ground lines and the PIN diodes may cause a high level of intermodulation to occur.

To solve the above-described problems, embodiments of the disclosed invention may be configured as follows:

According to a first aspect of the invention, a tunable multi-stage semi-coaxial cavity band pass filter, in which adjacent stages are electromagnetically coupled, ,may include: an outer conductor having inside a plurality of separate cavities divided by partitions; a rod-like inner conductor fixed on a bottom surface of each cavity, but not fixed on a surface which faces the bottom surface of each cavity; a frequency-adjusting screw made from a conductor and screwed through the surface which faces the bottom surface of each cavity, or through a lateral surface of each cavity; an input/output connector attached to the outer conductor; and a coupling slit provided at each partition provided between the adjacent cavities, in which adjacent stages are electromagnetically coupled; in which in each cavity, a dielectric held by a holder, which is movably inserted through the outer conductor, is inserted into each cavity, and a plurality of the holders have respective projecting portions which project out of the outer conductor, and the plurality of projecting portions are coupled by a coupling member.

According to a second aspect of the invention, a tunable semi-coaxial cavity band elimination filter may include: an outer conductor having inside a plurality of separate cavities divided by partitions; a rod-like inner conductor fixed on a bottom surface of each cavity, but not fixed on a surface which faces the bottom surface of each cavity; a frequency-adjusting screw made from a conductor and screwed through the surface which faces the bottom surface of each cavity, or through a lateral surface of each cavity; a transmission line having an input/output unit attached to the outer conductor; and a connector which electrically connects the transmission line to a resonating electromagnetic field occurring at each cavity; in which in each cavity, a dielectric held by a holder, which is movably inserted through the outer conductor, is inserted into each cavity, and a plurality of the holders have respective projecting portions which project out of the outer conductor, and the plurality of projecting portions are coupled by a coupling member.

Referring to the tunable band pass filter according to the first aspect of the invention, in a modification according to a third aspect of the invention, a movable region of the dielectric disposed in a predetermined cavity is a region other than a region defined by a bottom surface, which is an opening portion of the slit provided in the predetermined cavity, and an apex, which is an arbitrary point on the central axis of the inner conductor disposed in the predetermined cavity.

Referring to the tunable band pass filter according to the first or third aspect of the invention, a modification according to a fourth aspect of the invention further includes a mechanism for individually determining an insertion amount of each dielectric inserted into each cavity.

Referring to the tunable band elimination filter according to the second aspect of the invention, a modification according to a fifth aspect of the invention further includes a mechanism for individually determining an insertion amount of each dielectric inserted into each cavity.

According to a sixth aspect of the invention a duplexer includes: at least two filters; and an antenna connector connected to the filters in a shared manner, in which at least one of the filters is the tunable band pass filter according to any one of the first, third and fourth aspects of the invention.

According to a seventh aspect of the invention a communication apparatus includes: the duplexer according to the sixth aspect, a transmission circuit connected to at least one of the input/output connectors of the duplexer; a reception circuit connected to at least another one of the input/output connectors; and optionally, an antenna connected to the antenna connector of the duplexer.

With the first or second aspect of the invention, when the position, the angle, or both, of the dielectric inserted into the resonant cavity of each semi-coaxial cavity resonator with respect to the inner conductor is varied, perturbation is applied to an electric field occurring in the resonant cavity, so that the resonant frequency of each cavity resonator may be varied. In addition, since the holders of the dielectrics are coupled by the coupling member, the frequencies of the resonators are varied immediately at the same time, and by the same variation amount. Since the displacement amount of the coupling member is arbitrarily set within a movable range, there is provided a tunable filter that allows the center frequency of the band pass filter or the center frequency of an elimination band of the band elimination filter to be arbitrarily set within the movable range, and has good responsiveness.

Further, by movably coupling the holders to the coupling member, the perturbation amount may be varied in each of the resonators by way of a cam structure or the like. Owing to this, even if the filter is configured by continuously arranging resonators having resonant cavities with different profiles , the displacement amount of each of the dielectrics may be individually varied among the resonators. Therefore, since the variation amounts of the frequencies may be arbitrarily set for the resonators, respectively, with the tunable filter, deterioration of the filter characteristics may be restrained, and the center frequency may be freely selected.

Since the perturbation due to the dielectric is applied to the electric field in the resonant cavity, the decrease in Q of the resonator may be minimized by using a dielectric having a good dielectric loss tangent. In addition, since it is not necessary to use an active element such as a PIN diode in a resonant cavity to which extremely high current is applied, power resistance characteristics of the filter can be enhanced, thereby increasing reliability. Further, since it would be unnecessary to attach an excessive component like a PIN diode or a ground line combined with a PIN diode to the filter, there is provided a tunable filter in which intermodulation due to such excessive component does not occur.

With the third aspect of the invention, since the perturbation due to the displacement of the dielectric bar is not applied to the region where the adjacent resonators are electromagnetically coupled, the variation in relation to the coupling coefficients provided between the stages is suppressed while only the frequencies are varied. Accordingly, there is provided a tunable band pass filter in which a return loss waveform is less disordered.

With the fourth and fifth aspects of the invention, the insertion amounts, with respect to the cavities, of the dielectrics which allow the frequencies to be varied, can be determined appropriately. Accordingly, even when the filter has resonators having different cavity profiles or resonators having different sensitivities of the perturbation of the resonant frequencies with respect to the positional displacement of the dielectrics, the insertion amounts of the dielectrics may be pre-adjusted such that the perturbation amounts of the resonant frequencies become the same. In addition, the mechanism can be applied to fine adjustment of the frequencies during adjustment of the filter.

Other features and advantages of the present invention will become apparent from the following description of embodiments of the invention which refers to the accompanying drawings.

DETAILED DESCRIPTION OF EMBODIMENTS OF THE INVENTION

Figure 1A:
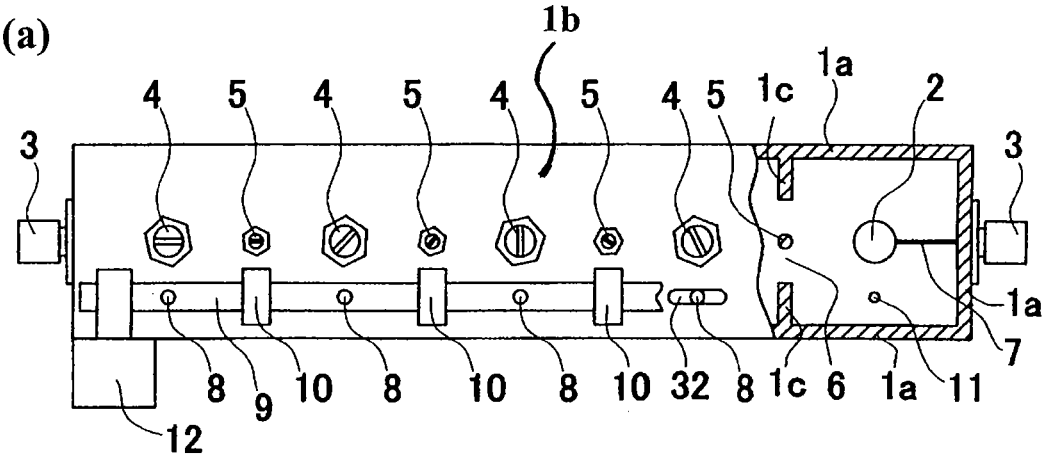
FIGS. 1(*a*)-1(*c*) are an explanatory illustration for showing a first embodiment of the present invention.
Figure 1B:
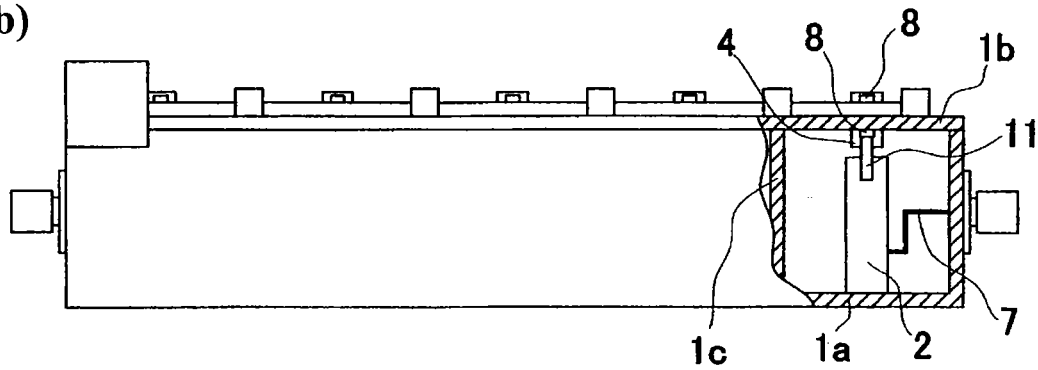
Figure 1C:
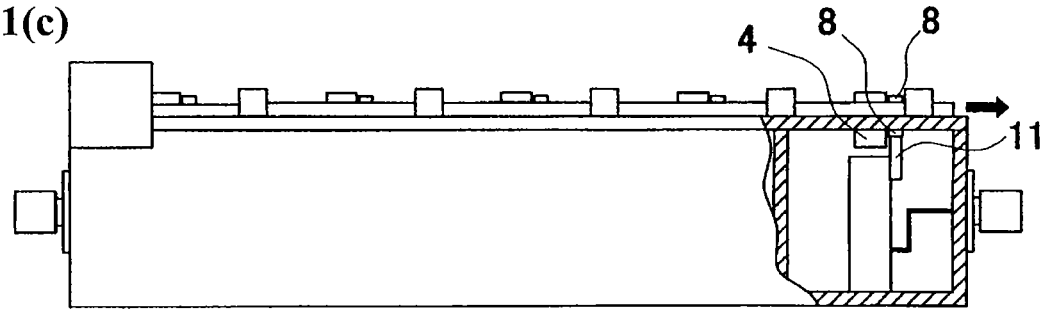
Figure 2A:
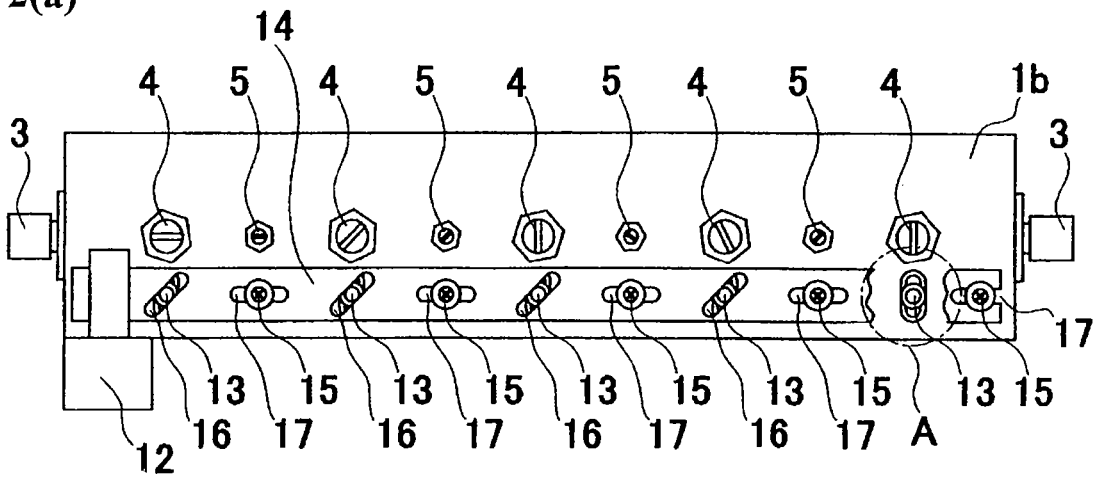
FIGS. 2(*a*)-2(*d*) are an explanatory illustration for showing a second embodiment of the present invention.
Figure 2B:
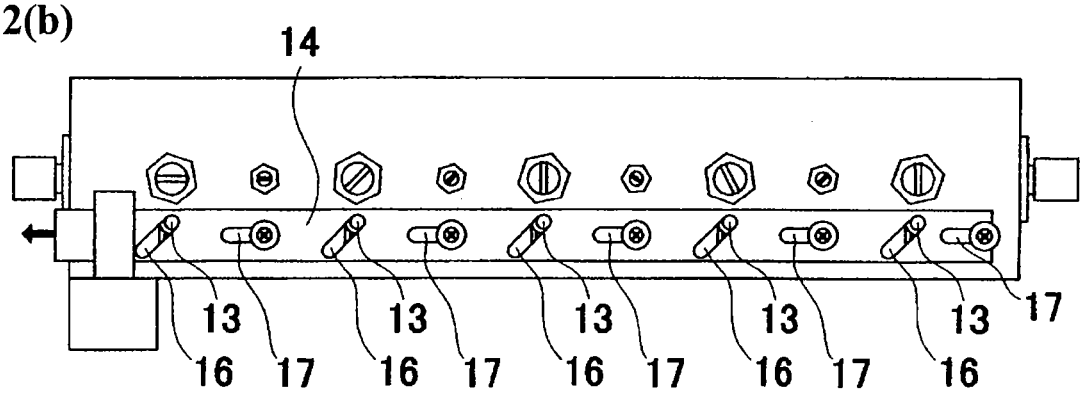
Figure 2C:
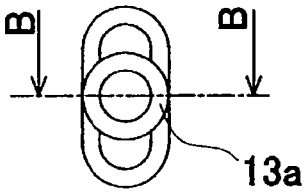
Figure 2C:
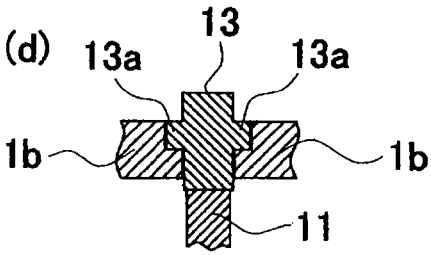

Referring to FIG. 1, a first embodiment of the present invention is described. FIG. 1 (*a*) is a plan view showing a 5-stage band pass filter to which the present invention is applied, and shows the inner space of the filter where a part of an outer conductor 1*b* is eliminated. FIG. 1(*b*) is a lateral view of FIG. 1(*a*), and shows the inner space of the filter with a part of an outer conductor 1*a* eliminated. FIG. 1 (*c*) is a comparative view showing a state where a frequency of the filter is varied in relation to FIG. 1 (*b*). The first embodiment is described with reference to these drawings.

The outer conductor 1*a* has a hollow structure with a surface being opened, and the hollow structure is divided by partitions 1*c* into cavities. The outer conductor 1*b* is made from a plate member and fixed at an opening of the outer conductor 1*a* with screws. Inner conductors 2 are fixed on a bottom surface of the outer conductor 1*a*. Each inner conductor 2 may be integrally formed with the outer conductor 1*a*, or may be fixed at the bottom surface of the outer conductor 1*a* with a screw, for example. While the inner conductor 2 is shown as a cylinder, the inner conductor 2 may be an elliptical cylinder, or a polygonal prism.

The inner conductor 2 is not fixed on a surface, which faces the outer conductor 1*a*, of the outer conductor 1*b*.

A frequency-adjusting screw 4 made from a conductor is screwed through the outer conductor 1*b* at a portion directly above the inner conductor 2, thereby forming a semi-coaxial cavity resonator. The frequency-adjusting screw 4 may be disposed at a portion other than the portion directly above the inner conductor 2, and may be screwed through a lateral surface of the outer conductor 1*a*.

Each resonator has a slit 6 where a part of the partition 1*c* is opened to achieve electromagnetic field coupling to the adjacent resonator. The opening of the slit 6 is extended to an upper end surface of the partition 1*c*. In addition, a coupling-adjusting screw 5 made from a conductor is screwed through the outer conductor 1*b* and projects into the slit 6 to adjust the degree of the electromagnetic field coupling to a desired value.

The resonators at the first and last stages have coupling probes 7 for coupling the resonators to input/output connectors 3.

On the basis of the above-described configuration, the first embodiment functions as a 5-stage band pass filter. Note that the number of stages may be determined as a design matter, with respect to desired characteristics.

A elongated hole 32 is provided in the outer conductor 1*b* for each cavity, and a holder 8 is inserted into the elongated hole 32 movably, in the horizontal direction in the drawing. An end of the holder 8 projects out of the outer conductor 1*b*, and fixed to a coupling member 9. A dielectric bar 11 is attached to the other end of the holder 8. A material of the coupling member 9 and the holder 8 may be appropriately selected from resin, metal, ceramic, and the like. The dielectric bar 11 may be fixed to the holder 8 by bonding, press-fitting, caulking, mechanical fixing, or by a combination of these, for example. The profile, the length, the dielectric constant, and the like, of the dielectric bar 11 may be appropriately determined. The profile of the dielectric bar 11 may be a cylinder, an elliptical cylinder, a polygonal prism, a cone, a plate, or the like. The higher the dielectric constant is, the larger a perturbation amount with respect to an electric field becomes, and the wider a variable range of the frequency becomes. In order to prevent intermodulation from occurring when high electric power is applied, the coupling member 9 and the holder 8 are preferably made of resin or ceramic having no conductivity.

The coupling member 9 is attached on a surface of the outer conductor 1*b* by guides 10 fixed at the outer conductor 1*b*, slidably in the lengthwise direction of the coupling member 9, and may be slid to a desired position by a driving portion 12. The driving portion 12 may drive the coupling member 9 to slide electrically, in response to an external electric signal, pneumatically, or manually, for example.

FIG. 1(*c*) shows a state where the coupling member 9 has slid to the right in the drawing. The dielectric bars 11 respectively inserted into the resonators move right relative to the inner conductors 2 at the same time. In terms of an electric field density distribution in the resonator, a portion close to the inner conductor 2 has a high density, and a portion away from the inner conductor 2 has a low density. In FIG. 1 (*c*), since the dielectric bars 11 move to the portions having the low electric density from the portions shown in FIG. 1 (*b*), the perturbation to the electric field caused by the dielectric bars 11 decreases, and the frequencies of the resonators increase substantially by the same amount at the same time.

The dielectric bar 11 may be located at a desired position within a movable range, so that the center frequency of the filter is varied continuously, not discretely.

To simplify the following description, components corresponding to the holder 8, the coupling member 9, the guide 10, the dielectric bar 11, and the driving portion 12, when shown in other drawings, are referred to as a tuning system.

Referring to FIG. 2, a second embodiment of the present invention is described. The basic configuration of the filter is similar to that of the first embodiment except for the tuning system.

FIG. 2(*a*) is a plan view showing a 5-stage band pass filter to which the present invention is applied. A coupling member 14 has a plurality of guide holes 17 parallel to the lengthwise direction thereof, and a plurality of flat cams 16 (diagonal grooves) each of which is provided at a predetermined angle to the lengthwise direction. In the coupling member 14, guide pins 15 having flanges are respectively inserted into the guide holes 17, and fixed at the surface of the outer conductor 1*b*, so that the coupling member 14 is attached on the surface of the outer conductor 1*b* slidably in the lengthwise direction of the filter.

FIG. 2(*c*) shows an enlarged view of a portion A in FIG. 2(*a*) with a part of the coupling member 14 eliminated. FIG. 2(*d*) shows a cross section B-B shown in FIG. 2(*c*) based on the enlarged view. A holder 13 has a flange 13*a*, and inserted into a elongate hole with a recess formed in the outer conductor 1*b*, to be movable relative to the outer conductor 1*b* and to function as a cam follower. A projecting portion of the holder 13 projecting out of the outer conductor 1*b* when the holder 13 is attached as described above, is inserted into the flat cam 16. The dielectric bar 11 is fixed to the holder 13 in a similar manner to the first embodiment.

FIG. 2(*b*) shows an illustration in which the coupling member 14 slides left in the drawing. Note that the coupling member 14 may be slid to a desired position by the driving portion 12. The holder 13 is moved by means of the flat cam 16 formed in the coupling member 14. Since the cam follower restrains the holder 13 from moving in the horizontal direction in the drawing, the horizontal movement of the coupling member 14 is transformed into a movement of the holder 13 in the vertical direction in the drawing due to the flat cam 16, so that a distance between the dielectric bar 11 and the inner conductor 2 is changed. In the example shown in FIG. 2(*b*), the dielectric bar 11 comes closer to the inner conductor as compared with that shown in FIG. 2(*a*).

In FIG. 2(*b*), though not shown, when the coupling member 14 slides to the rightmost position within a range restrained by the guide hole 17, the holder 13 moves downward in the drawing, and thereby the dielectric bar 11 comes away from the inner conductor 2.

As already described in the first embodiment, since the vicinity of the inner conductor has the higher electric field density in the semi-coaxial cavity resonator, the frequency of the resonator decreases when the dielectric bar 11 comes close to the inner conductor 2, while the frequency of the resonator increases when the dielectric bar 11 comes away from the inner conductor 2. Since this operation is exercised for all of the resonators at the same time, tuning may be exercised while the waveform of the center frequency of the filter is held.

In such configuration, since the respective angles of the flat cams 16 relative to the central axis of the coupling member 14 may be varied among the resonators, the displacement amounts of the holders 13 in the vertical direction in the drawing, when the coupling member 14 slides horizontally in the drawing, may vary among the resonators. If it is necessary to vary the perturbation amount of the frequency for each of the resonators, the angles of the flat cams 16 may be appropriately determined.

Figure 6:
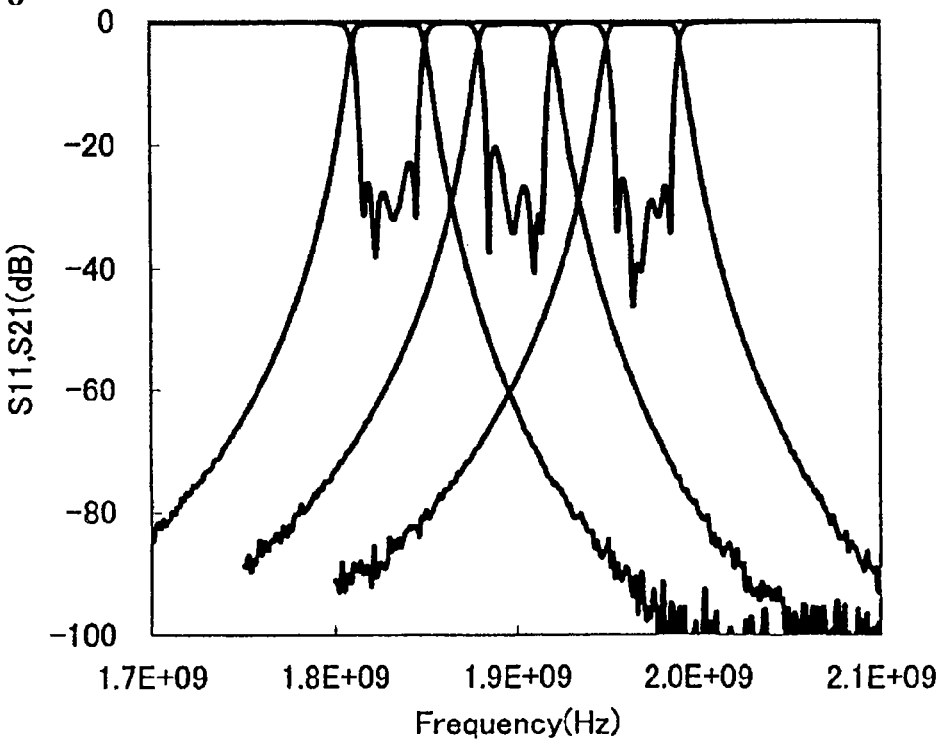
FIG. 6 is an explanatory illustration for showing a state of variation in characteristics of band pass filters according to the present invention.

The dielectric bar 11 may be made of a material having a relative dielectric constant of 92 and formed with a rare earth barium titanate compound. FIG. 6 shows examples of waveforms when the coupling member 14 is located at the position shown in FIG. 2(*a*), when the coupling member 14 is located at the leftmost position in the drawing [as shown in FIG. 2(*b*)] due to the restraint applied by the guide pins 15 and the guide holes 17, and when the coupling member 14 is located at the rightmost position in the drawing due to the restraint applied by the guide pins 15 and the guide holes 17. The center frequency of the filter may be selected from a range around 150 MHz.

In the second embodiment, the materials of the coupling member 14 and the holder 13, and the profile of the dielectric bar 11 are similar to those described in the first embodiment.

Figure 3A:
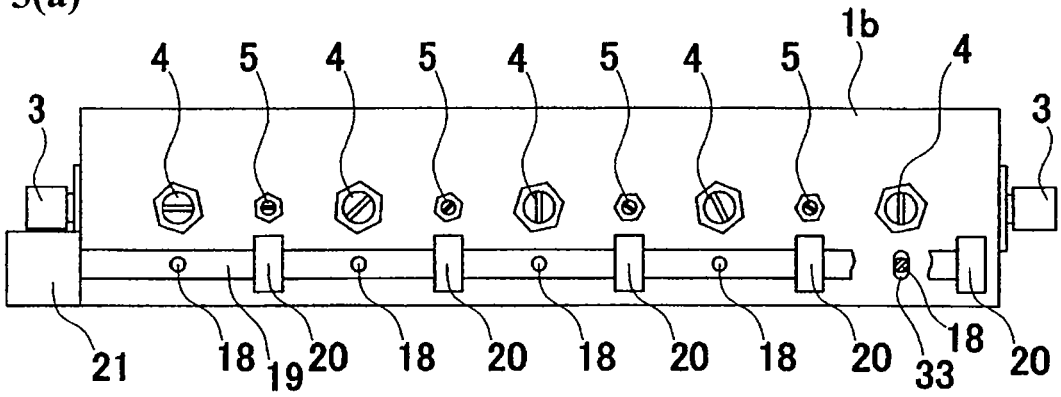
FIGS. 3(*a*)-3(*c*) are an explanatory illustration for showing a third embodiment of the present invention.
Figure 3B:
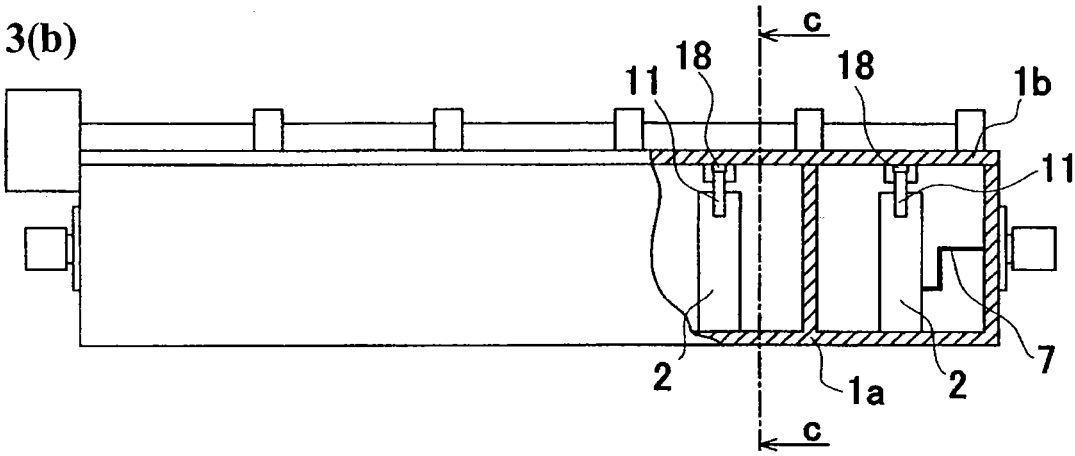
Figure 3C:
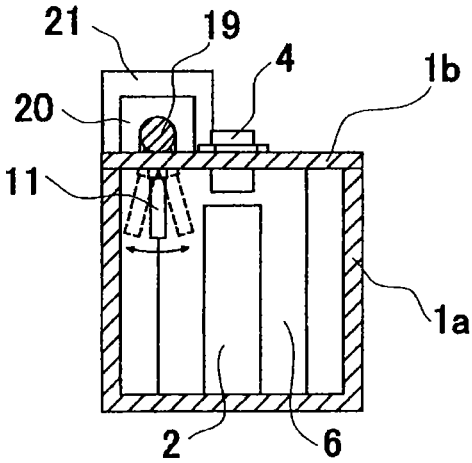

Referring to FIG. 3, a third embodiment of the present invention is described. Similar to the second embodiment, the basic configuration of the filter is similar to that of the first embodiment except for the tuning system.

FIG. 3(*a*) is a plan view showing a 5-stage band pass filter to which the present invention is applied. FIG. 3(*b*) is a lateral view of FIG. 3(*a*), and shows the inner space of the filter with a part of a wall of the outer conductor 1*a* eliminated. FIG. 3(*c*) is an enlarged view taken along a line cc shown in FIG. 3(*b*).

A coupling member 19 is a cylinder, held by guides 20 fixed at the outer conductor 1*b* in a rotatable manner relative to the center of a cross section of the coupling member 19. The elongated hole 33 is provided in the outer conductor 1*b* for each cavity, and a holder 18 is inserted into the elongated hole 33 movably in the vertical direction in the drawing. An end of the holder 18 projects out of the outer conductor 1*b*, and is fixed at the coupling member 19. The dielectric bar 11 is attached to the other end of the holder 18.

When the coupling member 19 is rotated by a driving portion 21, the dielectric bar 11 turns about the central axis of the cross section of the coupling member 19 as shown in FIG. 3(*c*), and a distance relative to the inner conductor 2 is varied.

As already described in the first embodiment, since the vicinity of the inner conductor has the higher electric field density in the semi-coaxial cavity resonator, the frequency of the resonator decreases when the dielectric bar 11 comes close to the inner conductor 2, while the frequency of the resonator increases when the dielectric bar 11 comes away from the inner conductor 2. Since this operation is exercised for all the resonators at the same time, tuning may be exercised while the waveform of the center frequency of the filter is held.

In these embodiments, if the inner space of each resonator defined by the outer conductors 1*a* and 1*b* is a cube having the size of 45 mm, and the inner conductor 2 is a cylinder having the diameter of 12 mm, the unloaded Q of the resonator becomes about 4,800. After inserting the cylindrical dielectric bar 11, which is formed with a rare earth barium titanate compound, a relative dielectric constant of 92, a dielectric loss tangent of 0.0005 at 2 GHz, a diameter of 5 mm, and a length of 20 mm, the decrease in the unloaded Q is about 3%, and the increase in the insertion loss of the filter is also about 3%. When a 5-stage filter having a center frequency of 2 GHz, and a bandwidth ratio of 1.5% is formed, the insertion loss of the filter without using the tuning system is about 0.6 dB, whereas the insertion loss thereof using the tuning system is about 0.62 dB. Therefore, the increment of the insertion loss is extremely small. In addition, the tuning system does not cause power resistance to be deteriorated or intermodulation to occur, and may form a band pass tunable filter having markedly reliable characteristics.

Figure 4A:
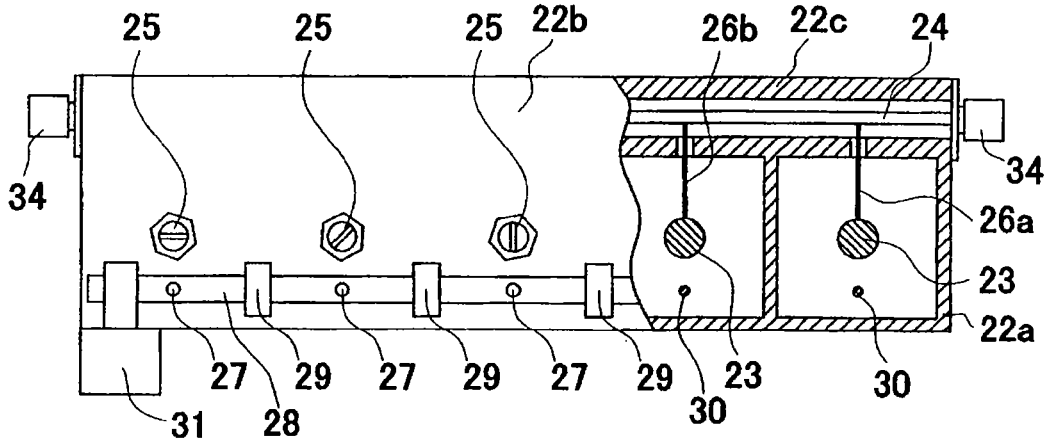
FIGS. 4(*a*)-4(*c*) are an explanatory illustration for showing a fourth embodiment of the present invention.
Figure 4B:
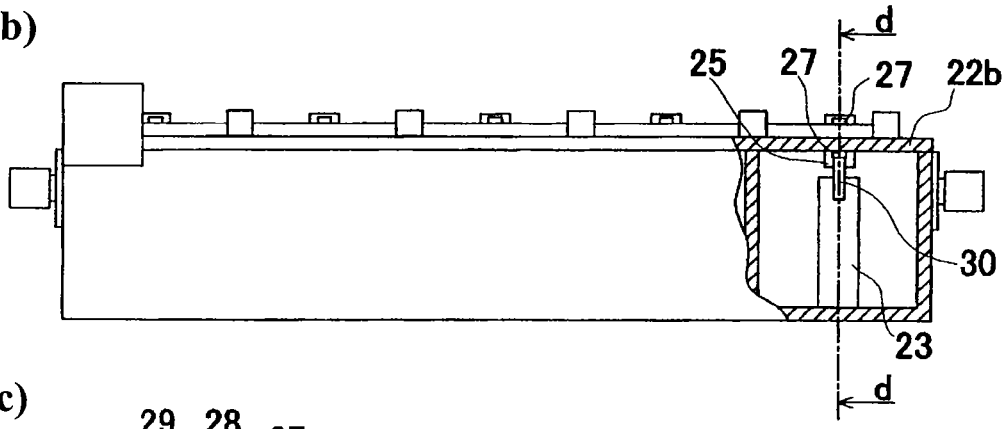
Figure 4C:
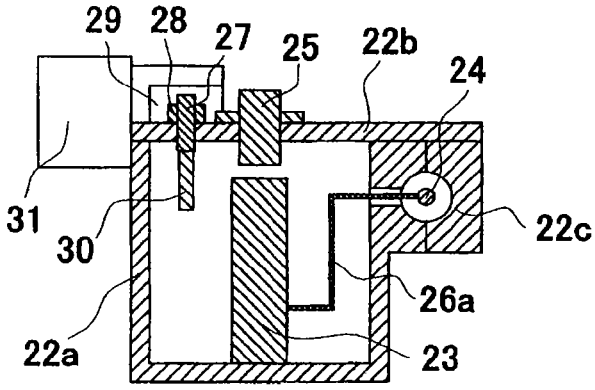

Referring to FIG. 4, a fourth embodiment of the present invention is described. FIG. 4(*a*) is a plan view showing a 5-stage band elimination filter to which the present invention is applied, and shows the inner space of the filter with a part of an outer conductor 22*b* eliminated. FIG. 4(*b*) is a lateral view of FIG. 4(*a*), and shows the inner space of the filter with a part of an outer conductor 22*a* eliminated. FIG. 4(*c*) is an enlarged view taken along a line d-d shown in FIG. 4(*b*).

Inner conductors 23 are fixed on a bottom surface of the outer conductor 22*a*. Each inner conductor 23 may be integrally formed with the outer conductor 22*a*, or may be fixed at the bottom surface of the outer conductor 22*a* with a screw. While the inner conductor 23 is shown as a cylinder, the inner conductor 23 may be a polygonal prism. The inner conductor 23 is not fixed on a surface, which faces the outer conductor 22*a*, of an outer conductor 22*b*. A frequency-adjusting screw 25 made from a conductor is screwed through the outer conductor 22*b* at a portion directly above each inner conductor 23, thereby forming each semi-coaxial cavity resonator. The frequency-adjusting screw 25 may be disposed at a portion other than the portion directly above the inner conductor 23, and may be screwed through a lateral surface of the outer conductor 22*a*. Though not shown, the outer conductors 22*b* and 22*c* are fixed at the outer conductor 22*a* with screws.

Each resonator has a completely closed space. Coupling probe 26*a* or 26*b* is provided at each inner conductor 23, to couple each inner conductor 23 to a central conductor 24 of the transmission line provided at a lateral surface of the outer conductor 22*a*. The coupling probes 26*a* and 26*b* may be coupled to different positions of the inner conductors 23, or their profiles may be different, in order to obtain desired coupling amounts. This may also be applied to the resonator, the inside of which is not shown.

The central conductor 24 is provided in a cylindrical cavity provided at the outer conductors 22*a* and 22*c*, and forms a transmission line having an impedance of 50 Ω. Ends of the central conductor 24 are respectively connected to input/output connectors 34.

On the basis of the above-described configuration, the fourth embodiment functions as a 5-stage band elimination filter. Note that the number of stages may be determined as a design matter, in accordance with desired characteristics.

The configuration, action and effect of the tuning system including a holder 27, a coupling member 28, a guide 29, a dielectric 30, and a driving portion 31, are similar to that described in the first embodiment. The configuration of the tuning system may alternatively employ the system described in the second embodiment or the third embodiment.

Figure 5A:
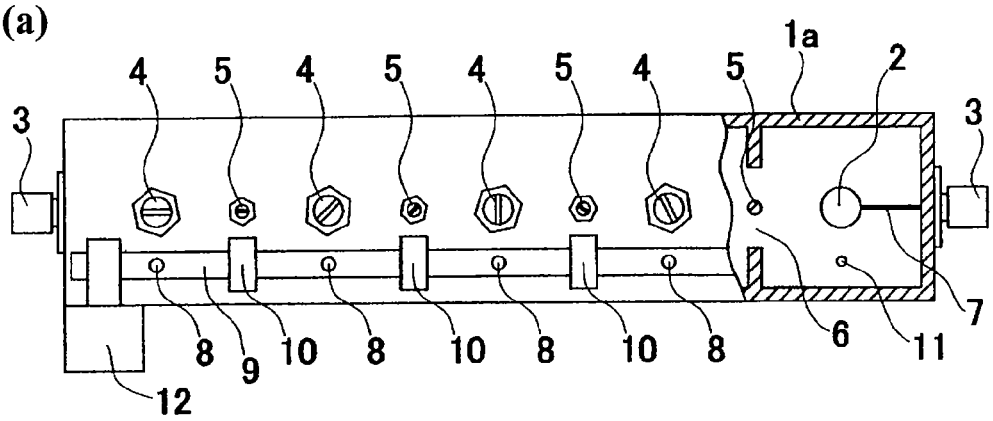
FIGS. 5(*a*)-5(*b*) are an explanatory illustration for showing a fifth embodiment of the present invention.
Figure 5B:
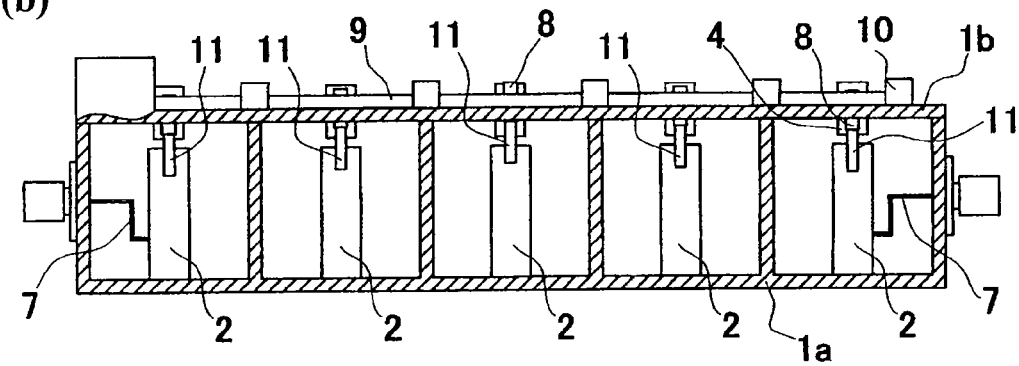

Referring to FIG. 5, a fifth embodiment of the present invention is described. FIG. 5(*a*) is a plan view showing a 5-stage band pass filter, and shows the inner space of the filter with a part of an upper panel eliminated. FIG. 5(*b*) is a lateral view of FIG. 5(*a*), and shows the inner space of the filter with the whole lateral surface eliminated. The present embodiment is a modification of the first embodiment, and the basic configurations of the filter and the tuning system are similar to that of the first embodiment.

The holders 8 are screwed through the coupling member 9, and the insertion amounts of the holders 8 are arbitrarily determined respectively for the resonators. FIG. 5(*b*) shows the resonators, in which the insertion amounts of the holders 8 are varied. In this embodiment, since the positions in the height direction of the dielectric bars 11 with respect to the inner conductors 2 are relatively varied, the variation amounts of the respective frequencies among the resonators are different when the positions of the dielectric bars 11 are varied as shown in FIG. 1 (*c*).

To shift the center frequency without deforming the waveform of the filter, the frequencies of the resonators must be evenly shifted. However, the shift amounts of the frequency according to the positional displacement of each of the dielectric bars 11 may be varied among the resonators, because of the difference in size of the slits 6, the difference in insertion amount of the frequency-adjusting screws 4, or the difference in insertion amount of the coupling-adjusting screws 5. To accommodate the difference in shift amounts of the frequencies, the insertion amount of each of the dielectric bars 11 may be intentionally varied among the resonators. The insertion amounts of the dielectric bars 11 may be obtained experimentally.

Specific adjustment steps are as follows.

First, the same insertion amount of the dielectric bar 11 is applied to all resonators. Then, the coupling member 9 is directed to slide such that each dielectric bar 11 is located at the farthest position from the inner conductor 2. In this state, the insertion amount of each dielectric bar 11 does not considerably affect the frequency of each resonator. Holding this state, the filter is adjusted to have predetermined characteristics (characteristics to realize a state where the center frequency of a pass band of the tunable filter is the highest) by using the frequency-adjusting screw 4 and the coupling-adjusting screw 5.

Then, the coupling member 9 is directed to slide such that each dielectric bar 11 is located at the closest position to the inner conductor 2. At this time, if the same shift amount of the resonance frequency is applied to all resonators, the pass band of the filter holds its characteristics (profile of the pass band), and only the center frequency is varied to a low-frequency state.

If the shift amounts of the frequencies are different among the resonators and the pass band characteristics are deteriorated, the insertion amounts of the dielectric bars 11 are adjusted to correct the characteristics.

In this way, the characteristics with the highest center frequency and the characteristics with the lowest center frequency of the pass band of the filter are adjusted to the desired characteristics. The filter adjusted according to this method may hold its characteristics even when the center frequency is set at an arbitrary value between the highest point and the lowest point, and may achieve a reliable band pass tunable filter.

Generally, the frequency is adjusted by using the frequency-adjusting screw 4 in the filter-adjusting phase. However, alternatively, the insertion amount of the dielectric bars 11 may be adjusted to adjust a slight deviation among the frequencies in the final-filter-adjusting phase.

The fifth embodiment has been described based on an example of the band pass filter. However, the band elimination filter described in the fourth embodiment may be alternatively applied to the fifth embodiment.

In addition, any of the embodiments may have a plurality of tuning systems.

Although the present invention has been described in relation to particular embodiments thereof, many other variations and modifications and other uses will become apparent to those skilled in the art. Therefore, the present invention is not limited by the specific disclosure herein.

The invention claimed is:

1. A tunable multi-stage semi-coaxial cavity band pass filter, in which adjacent stages are electromagnetically coupled, comprising:

an outer conductor having inside a plurality of separate cavities separated by partitions;

a rod-shaped inner conductor fixed on a bottom surface of each cavity, but not fixed on a top surface which faces the bottom surface of each cavity;

a frequency-adjusting screw made from a conductor and screwed through the top surface which faces the bottom surface of each cavity, or through a lateral surface of each cavity;

an input/output connector attached to the outer conductor; and a coupling slit provided in each partition provided between the adjacent cavities, in each cavity, a dielectric bar extending from said top surface for being electromagnetically coupled with said inner conductor, said dielectric bar being held by a holder, which is movably inserted through the outer conductor, and into said cavity, and a plurality of the holders have respective projecting portions which project out of the outer conductor, and the plurality of projecting portions are coupled by a movable coupling member disposed outside said outer conductor and located laterally offset from the inner conductors, wherein a movement of said coupling member causes the respective dielectric bars of said plurality of holders to move simultaneously in a defined plane that is perpendicular to said top surface for varying said electromagnetic coupling between the dielectric bars and the inner conductors.

2. The tunable band pass filter according to claim 1, wherein each of said plurality of holders comprises a mechanism for individually determining an insertion amount of the corresponding one of said dielectric bars inserted into the corresponding cavity.

3. A tunable semi-coaxial cavity band elimination filter comprising:

an outer conductor having inside a plurality of separate cavities separated by partitions;

a rod-shaped inner conductor fixed on a bottom surface of each cavity, but not fixed on a top surface which faces the bottom surface of each cavity;

a frequency-adjusting screw made from a conductor and screwed through the top surface which faces the bottom surface of each cavity, or through a lateral surface of each cavity;

an electrical transmission line having an input/output unit attached to the outer conductor; and a plurality of respective connectors which electrically connect the transmission line to a resonating electromagnetic field occurring at each cavity, in each cavity, a dielectric bar extending from said top surface for being electromagnetically coupled with said electromagnetic field, said dielectric bar being held by a holder, which is movably inserted through the outer conductor, and into said cavity, and a plurality of the holders have respective projecting portions which project out of the outer conductor, and the plurality of projecting portions are coupled by a movable coupling member disposed outside said cavities and located laterally offset from the inner conductors;

wherein a movement of said coupling member causes the dielectric bars of said plurality of holders to move simultaneously in said cavities in a defined plane that is perpendicular to said top surface, for varying said electromagnetic coupling between the dielectric bars and the inner conductors.

4. The tunable band elimination filter according to claim 3, wherein each of said plurality of holders comprises a mechanism for individually determining an insertion amount of the corresponding said dielectric bar inserted into the corresponding cavity.

5. A duplexer comprising: at least two filters; and an antenna connector connected to the filters in a shared manner, wherein at least one of the filters is the tunable band pass filter according to any one of claims 1 and 2.

6. A communication apparatus comprising: the duplexer according to claim 5, a transmission circuit connected to at least one input/output connector of the duplexer; and a reception circuit connected to another input/output connector.

7. The communication apparatus according to claim 6, further comprising an antenna connected to the antenna connector of the duplexer.

8. The communication apparatus according to claim 1 or claim 3, wherein a horizontal movement of said coupling member causes a movement of said dielectric bars in a defined vertical plane extending along an extension direction of said plurality of cavities.

9. The communication apparatus according to claim 1 or claim 3, wherein said coupling member has cam surfaces engaged with said projecting portions, such that a horizontal movement of said coupling member causes movement of said dielectric bars in a defined vertical plane extending at an angle to an extension direction of said plurality of cavities.

10. The communication apparatus according to claim 1 or claim 3, wherein said coupling member is rotatable, for causing a corresponding rotational movement of the corresponding dielectric bars in a defined vertical plane that is transverse to an extension direction of said coupling member.

* * * * *